US007377125B2

(12) United States Patent
Seiden et al.

(10) Patent No.: US 7,377,125 B2
(45) Date of Patent: May 27, 2008

(54) WALK-IN REFRIGERATOR/FREEZERS AND WINE COOLERS FOR HOME USE

(75) Inventors: Dale Seiden, Marina Del Rey, CA (US); Ron Levy, Malibu, CA (US); Adrian E. Crisci, Whittier, CA (US)

(73) Assignee: Cold Fusion Industries, LLC, Los Angeles, CA (US)

( * ) Notice: Subject to any disclaimer, the term of this patent is extended or adjusted under 35 U.S.C. 154(b) by 282 days.

(21) Appl. No.: 10/969,651

(22) Filed: Oct. 20, 2004

(65) Prior Publication Data

US 2006/0080994 A1 Apr. 20, 2006

(51) Int. Cl.
*F25D 11/02* (2006.01)

(52) U.S. Cl. ..... 62/441; 62/443

(58) Field of Classification Search ..... 62/446, 62/445, 441, 259.1, 457.8, 252, 254, 447, 62/443; 312/401, 402, 404
See application file for complete search history.

(56) References Cited

U.S. PATENT DOCUMENTS 1,628,083 A * 5/1927 Vogt ..... 62/382
1,707,484 A * 4/1929 Keener ..... 62/382
2,003,274 A * 5/1935 Celander ..... 62/440
2,194,177 A * 3/1940 Rundell ..... 62/252
2,601,634 A * 6/1952 Rivette ..... 62/443
3,804,482 A * 4/1974 Smith ..... 312/236
5,848,534 A * 12/1998 Stauffer ..... 62/91
6,351,967 B1 * 3/2002 Adachi et al. ..... 62/441
6,525,659 B2 * 2/2003 Jaffe et al. ..... 340/545.6
D487,278 S * 3/2004 Segers ..... D15/86
6,981,597 B2 * 1/2006 Cash ..... 211/74

* cited by examiner

*Primary Examiner*—Cheryl Tyler
*Assistant Examiner*—Emily Iris Nalven
(74) *Attorney, Agent, or Firm*—Patrick F. Bright

(57) ABSTRACT

Walk-in refrigerator/freezers and walk-in refrigerator/wine coolers for home use include walk-in refrigerator sections, reach-in freezer sections, pullout pantries and pullout refrigerated drawers, and wine cooler/humidor sections that may include one or two separate interior temperature-controlled sections.

9 Claims, 11 Drawing Sheets

WALK-IN REFRIGERATOR/FREEZERS AND WINE COOLERS FOR HOME USE

This invention relates to walk-in refrigerator/freezer units intended for use in homes and other non-commercial venues. These units preferably include a walk-in refrigerator section, a reach-in freezer section, a pullout pantry and one or more pullout refrigerated drawers. The cold air curtain will be available not only at the walk-in refrigerator door but also on the freezer exterior as well as the interior doors in order to help maintain better interior temperatures as the various door are used. This invention also relate to walk-in wine cooler/humidors that may include at least two separate, interior, temperature-controlled sections.

The walk-in refrigerator/freezer section units and the wine-cooler/humidor units may include one or more of the following: a walk-in refrigerator section; a reach-in freezer section; a pull-out pantry section; one or more pull-out refrigerator drawers; an entry door, preferably a glass door, for entrance into the walk-in refrigerator section; one or more doors, preferably glass doors, for entry into reach-in freezer sections; exposed front mullions; an exterior size and shape that fits into kitchen cabinet-sized spaces in homes and other non-commercial venues; cam-type pivot door hinges; large capacity, e.g., at least about 100-pound, drawer slides, preferably stainless-steel drawer slides; a plurality of freezer drawers, preferably stainless-steel freezer drawers; a freezer door and exterior drawers, preferably a stainless-steel freezer door and exterior drawers; food pans in the exterior drawers, preferably stainless-steel food pans; exterior and interior surfaces, preferably made of stainless-steel; an entry ramp into the walk-in refrigerator section; a freezer section with an ice maker; a pantry-style drawer system inside the walk-in refrigerator section; sliding doors, preferably glass doors, for access to the freezer section from the interior of the walk-in refrigerator section; storage shelving, preferably stainless-steel shelving, inside the walk-in refrigerator section; interior halogen spotlighting; interior martini rails, interior stem martini glass rails, or both, for storage of bottles and glasses inside the freezer section; a dual temperature control system; a refrigerator storage capacity of at least about 60 cubic feet; a freezer storage capacity of at least about 20 cubic feet; an integrated dual refrigeration system; digital temperature displays and electronic controllers; air curtain cooling systems that form a cold air barrier, e.g., at the entrance to the walk-in refrigerator section, and that help to maintain uniform air temperature in the interior of the walk-in refrigerator section, and/or in the freezer exterior and/or at one or more interior doors to help maintain desired temperatures at these locations; an evaporator coil with variable speed fan; a hot gas defrost system; an expansion valve in the evaporator to allow rapid recovery; an evaporator coil system positioned atop the unit in a housing section; an internal motion sensor and/or a pressure sensitive ramp that actuate a safety lock for the door to the walk-in refrigerator section to prevent the door from closing; a shutdown safety system activated by time sensors and/or internal sensors with manual override; an UV-C air sanitizer in the walk-in refrigerator section to preserve product freshness and eliminate odors; interior wine storage racks, preferably made of wood such as mahogany, and preferably including a decorative arch; a built-in humidor in the walk-in refrigerator section; slide-out wine storage shelves in the reach-in sections; and a plurality of temperature-controlled, reach-in wine cooler sections.

BRIEF DESCRIPTION OF THE DRAWINGS

The walk-in refrigerator/freezer and walk-in wine-cooler/humidor can better be understood by reference to the drawings in which.

DETAILED DESCRIPTION OF THE PREFERRED EMBODIMENT

Figure 1:
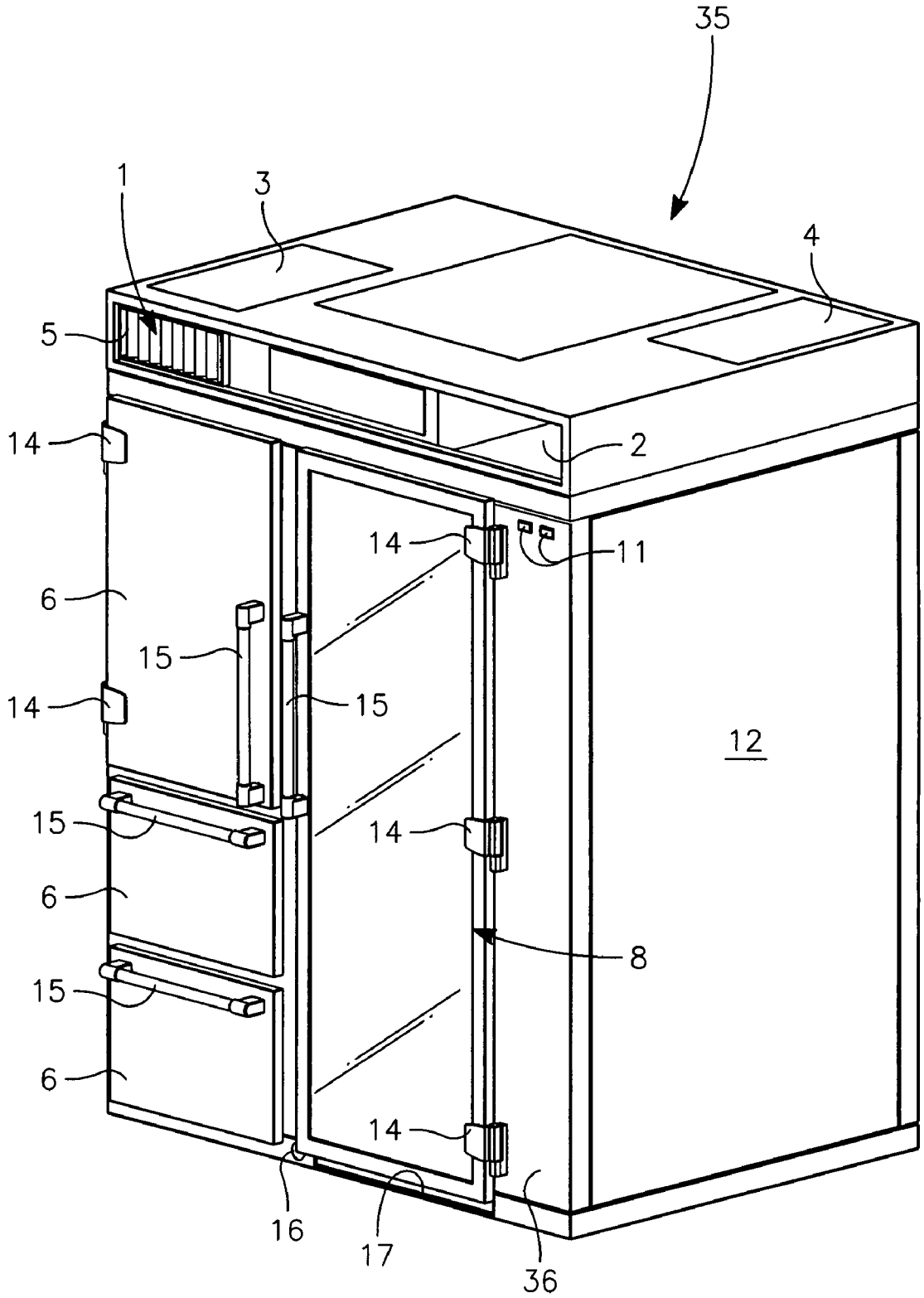
FIG. 1 shows a perspective view of an embodiment of the walk-in refrigerator/freezer.
Figure 2:
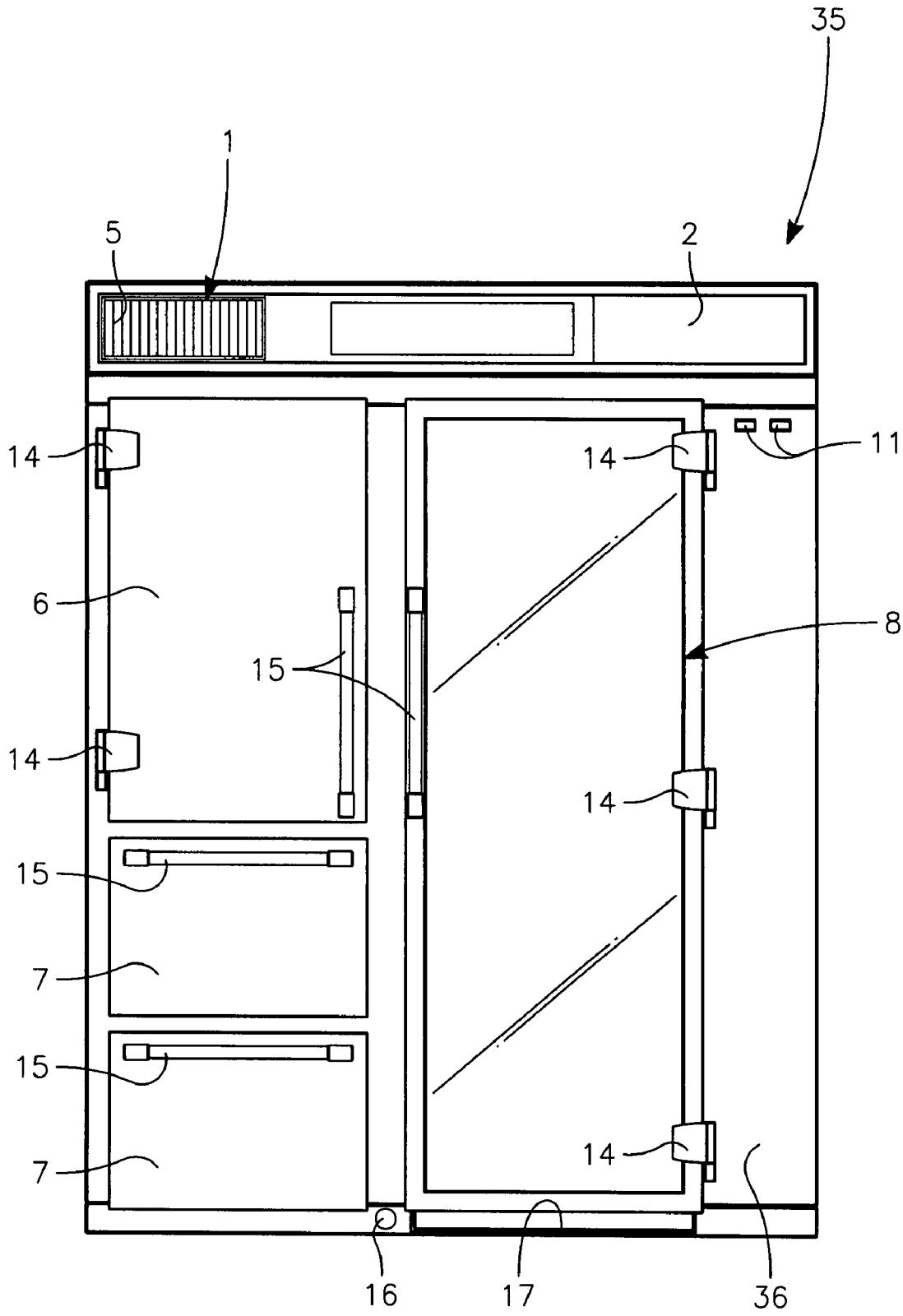
FIG. 2 shows a front view of the walk-in refrigerator/freezer shown in FIG. 1.

FIGS. 1, 2, 3, and 4 show refrigerator/freezer unit 35 includes stainless-steel body 12. Body 12 includes glass door 8, attached to front panel 36 of body 12, by hinges 14 that are side/front mounted. Glass door 8 includes pull handle 15. Glass door 8 opens into the walk-in refrigerator section of unit 35 (see FIG. 4). Unit 35 includes an internal freezer section with a stainless-steel freezer door 6, having pull handle 15 and side/front mount hinges 14. The freezer section of unit 35 also includes refrigerator drawers 7 with pull handles 15. Atop unit 35 are front air intake panel 1, front air exhaust panel 2, removable top air intake panel 3, and removable top air exhaust panel 4. Replaceable air intake filter 5, pleated for high efficiency, forms the entryway to front air intake opening 1. Unit 35 also includes foot switch 16, which automatically opens glass door 8 when touched. Access ramp 17 permits ease of entry into the refrigerator section of unit 35.

Figure 3:
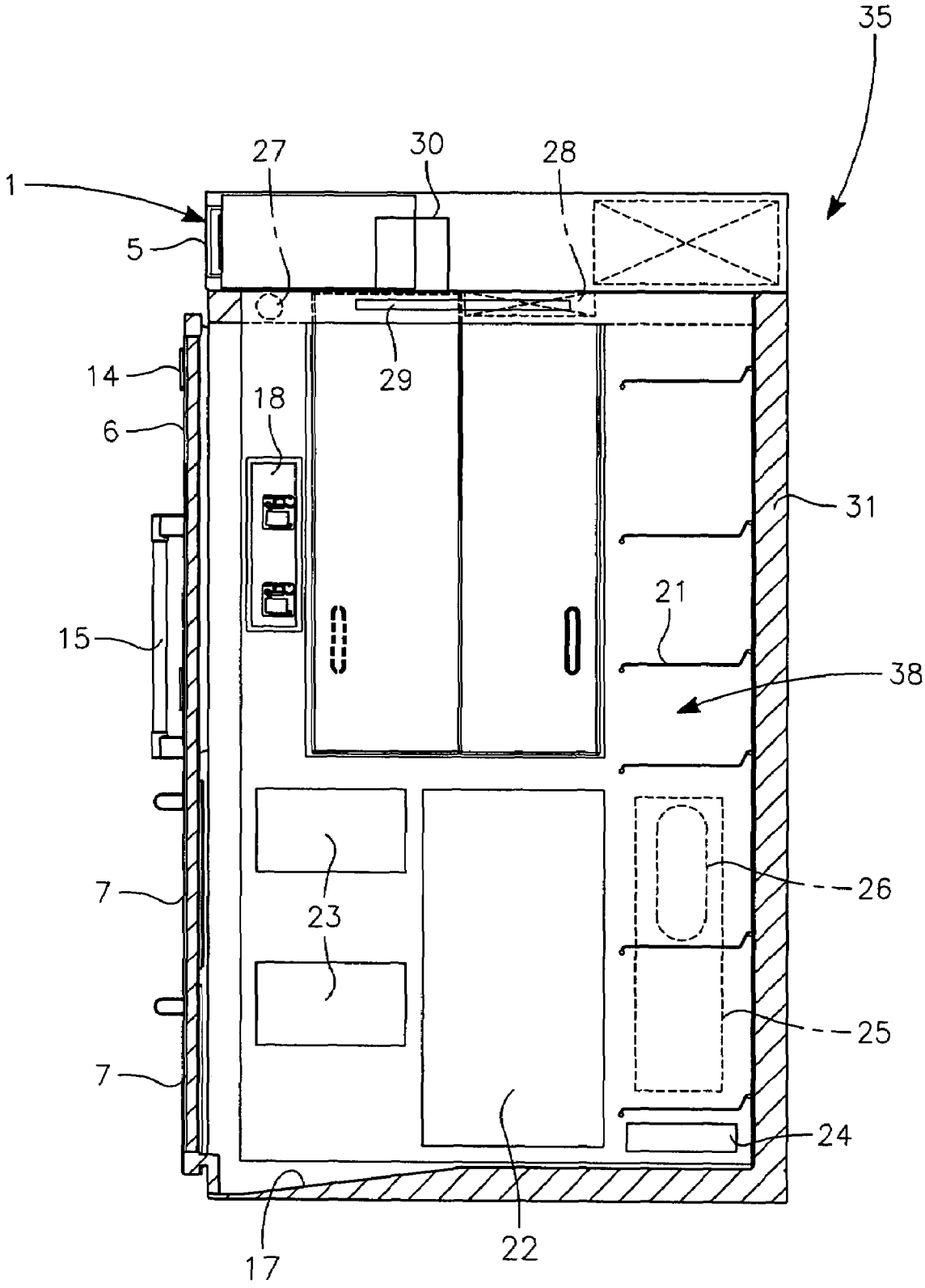
FIG. 3 shows a profile view of the walk-in refrigerator/freezer shown in FIGS. 1 and 2.
Figure 4:
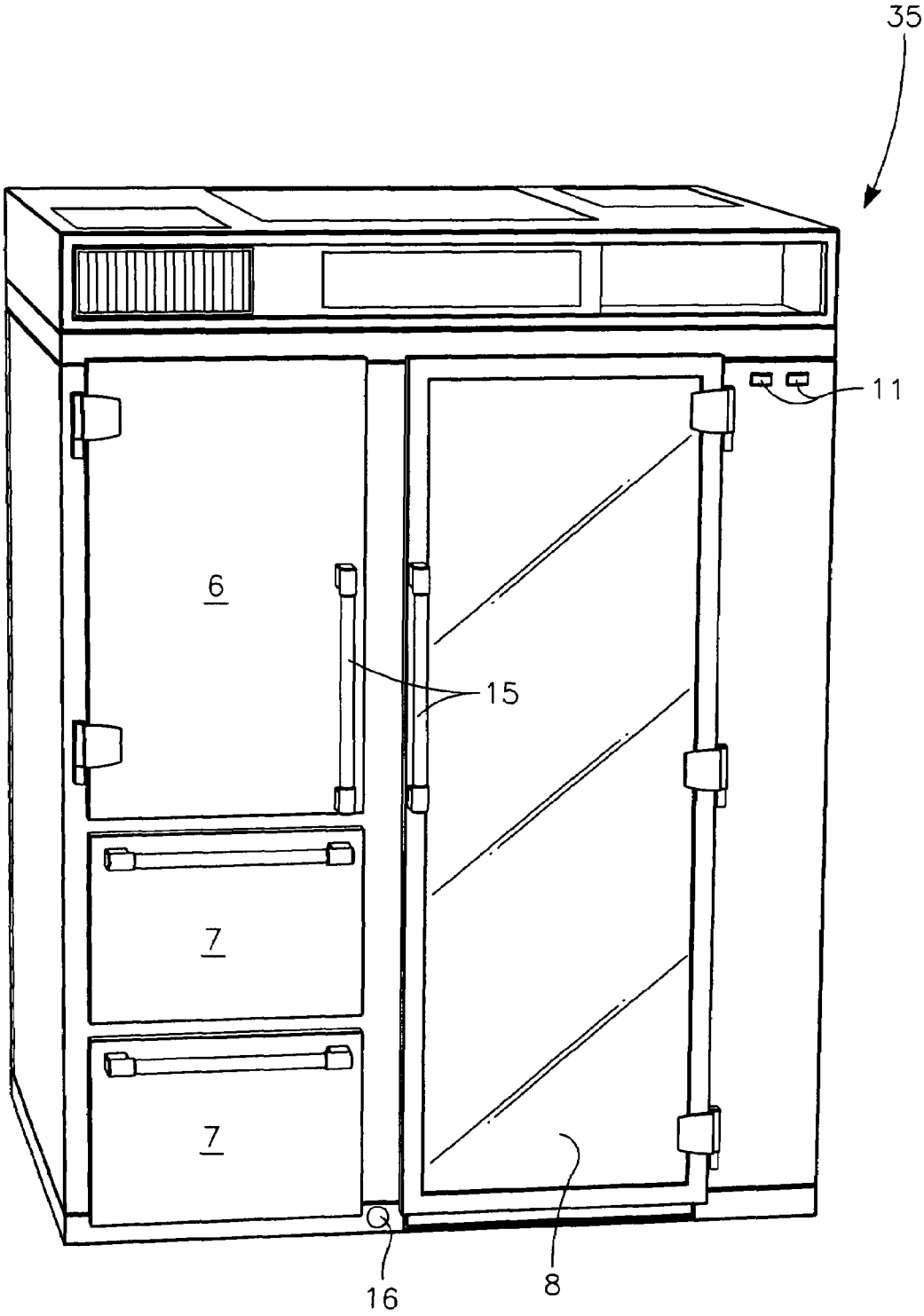
FIG. 4 shows a front elevation view of the walk-in refrigerator/freezer shown in FIGS. 1, 2 and 3, with the door to the walk-in refrigerator open to show some interior features.

FIG. 3 shows refrigerator section 38 in unit 35. Inside refrigerator section 38 are a main panel with controls 18 for temperature adjustment, temperature monitoring digital indicators 11 (see FIG. 1), and indicators of temperature and other conditions within the refrigerator/freezer. Atop unit 35 are a compressor, a fan, a condenser coil, and an evaporation area 19. Within section 38 are adjustable shelving 21, pantry slide out cabinet system 22, a circulation fan system for drawer section 23, air return channel 24, water purification system 25, humidification system 26, presence sensor 27, evaporator and fan area for the freezer/refrigerator 28, UV-C air sanitizing system 29, automatic door opening mechanism 30, urethane foam core installation 31, and glass rail 32.

Figure 5:
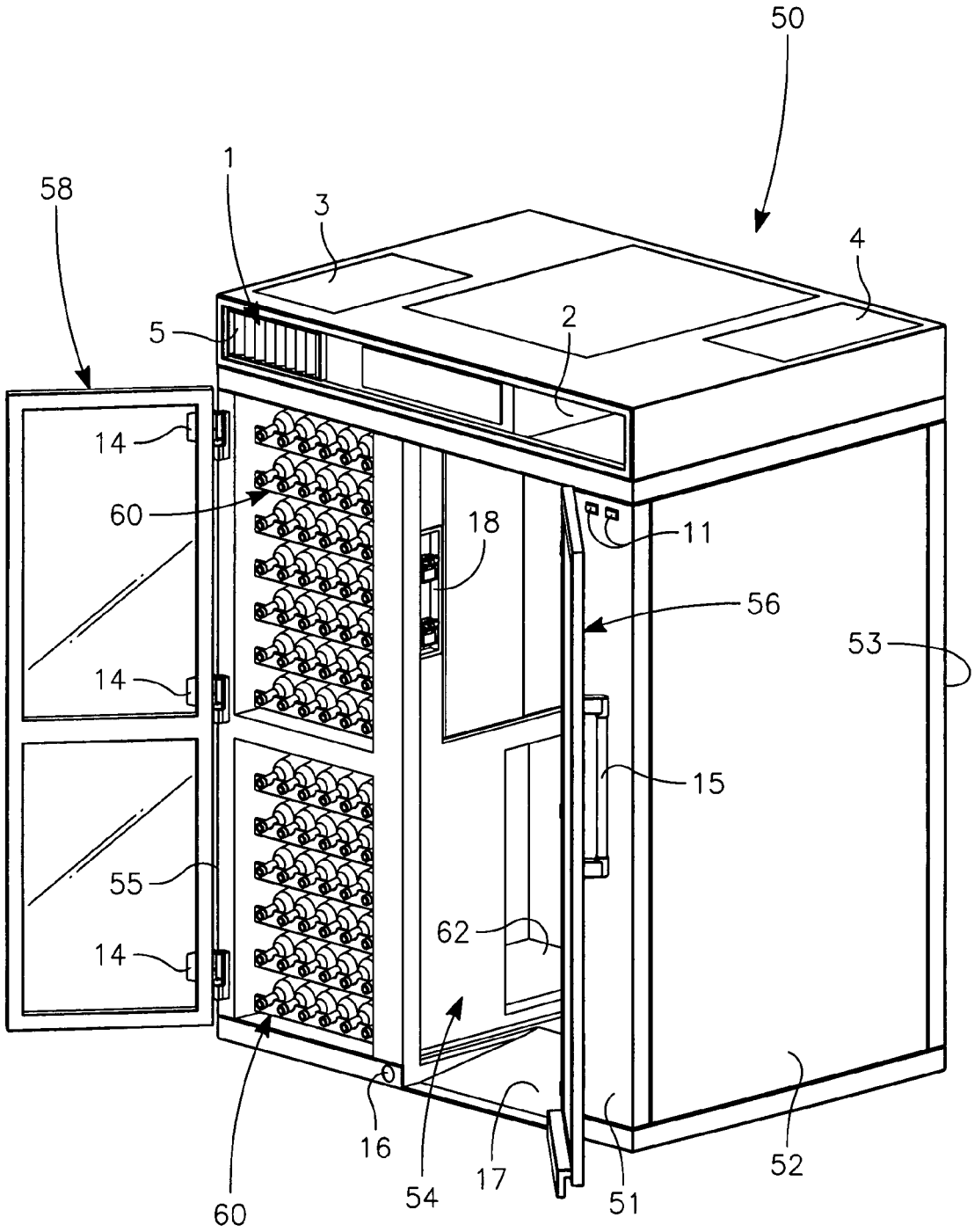
FIG. 5 shows a perspective view of an embodiment of the walk-in wine cooler/humidor.
Figure 6:
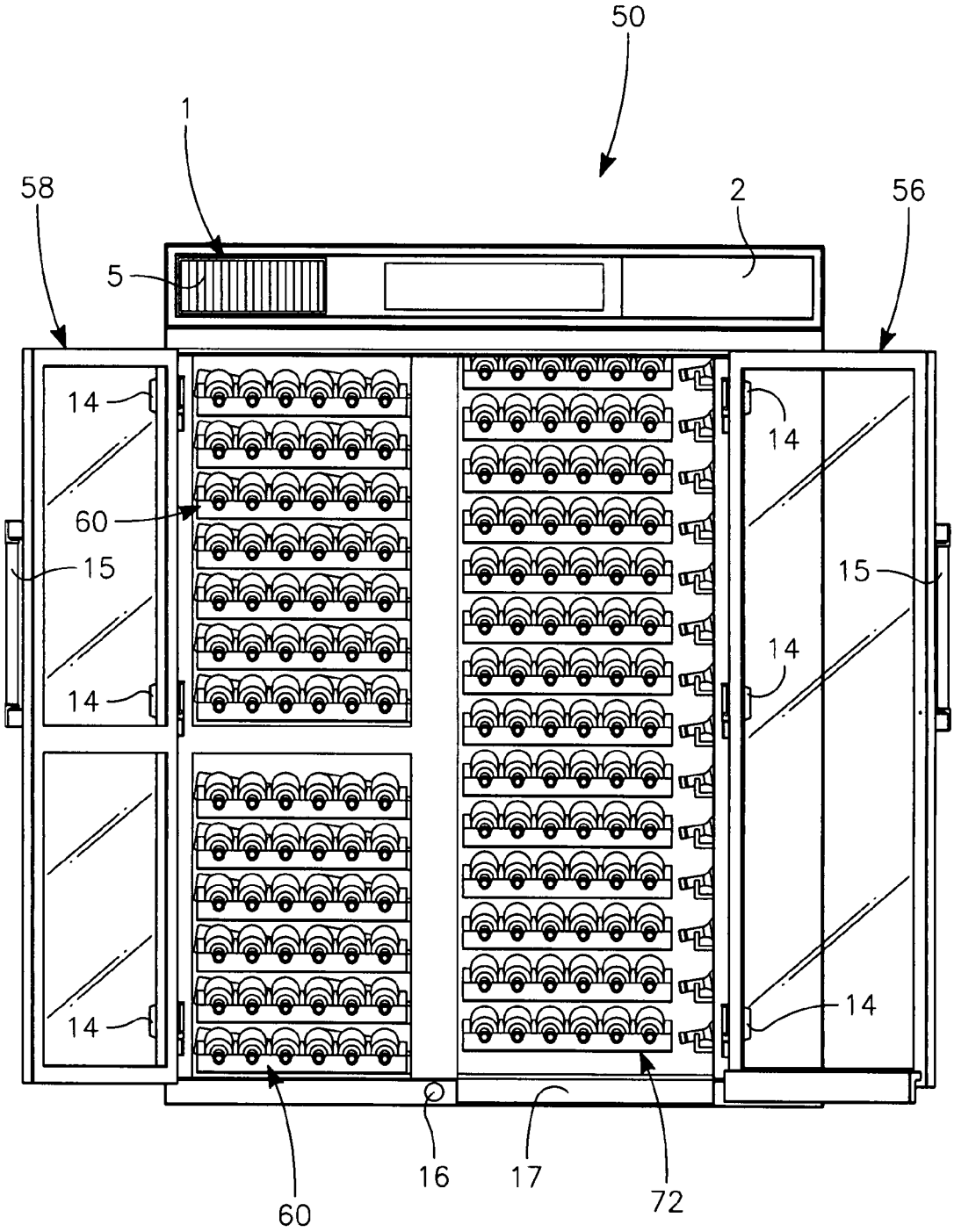
FIG. 6 shows a front view of the walk-in wine cooler/humidor shown in FIG. 5.
Figure 7:
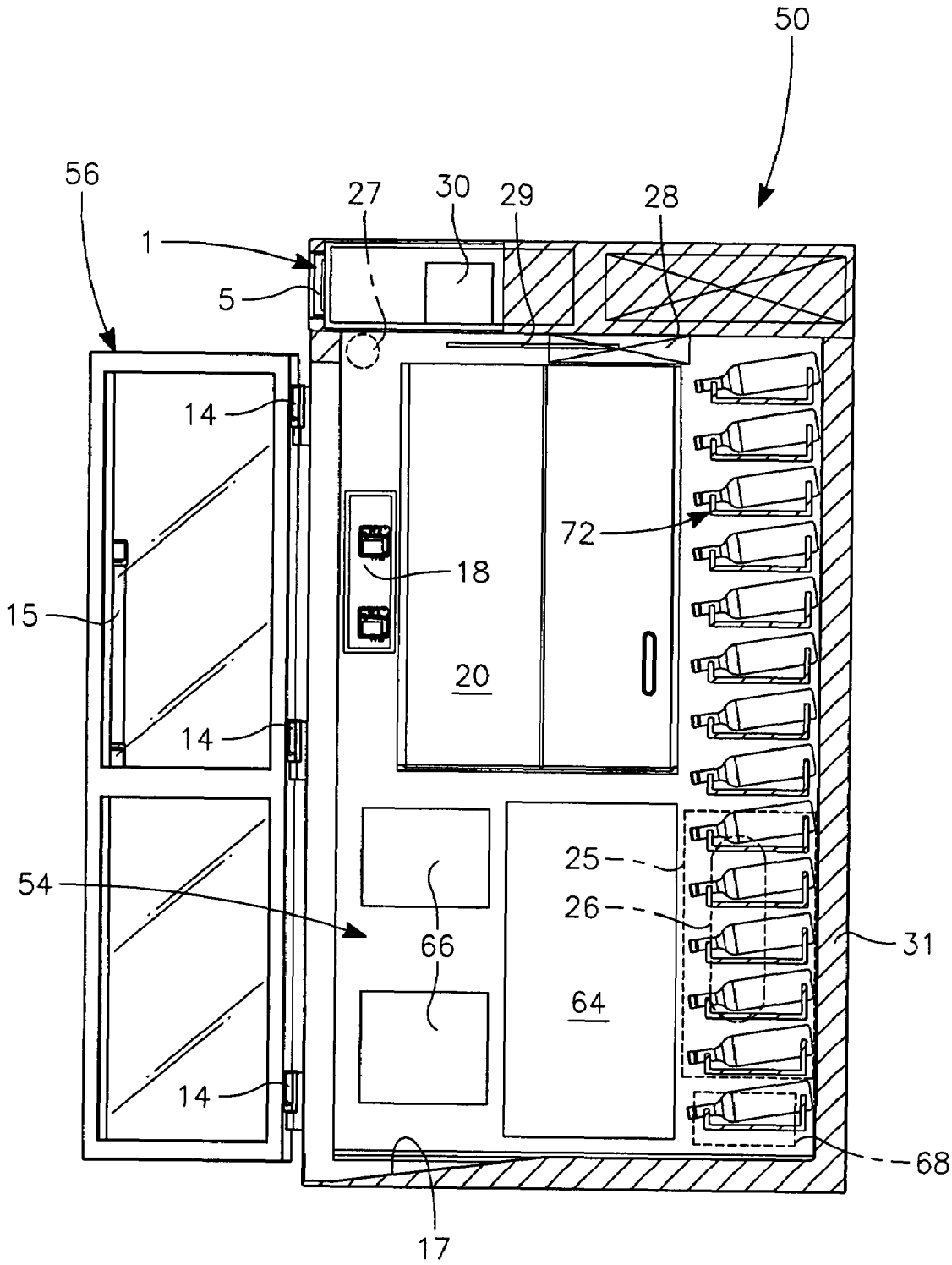
FIG. 7 shows a profile view of the walk-in wine cooler/humidor shown in FIGS. 5 and 6.
Figure 8:
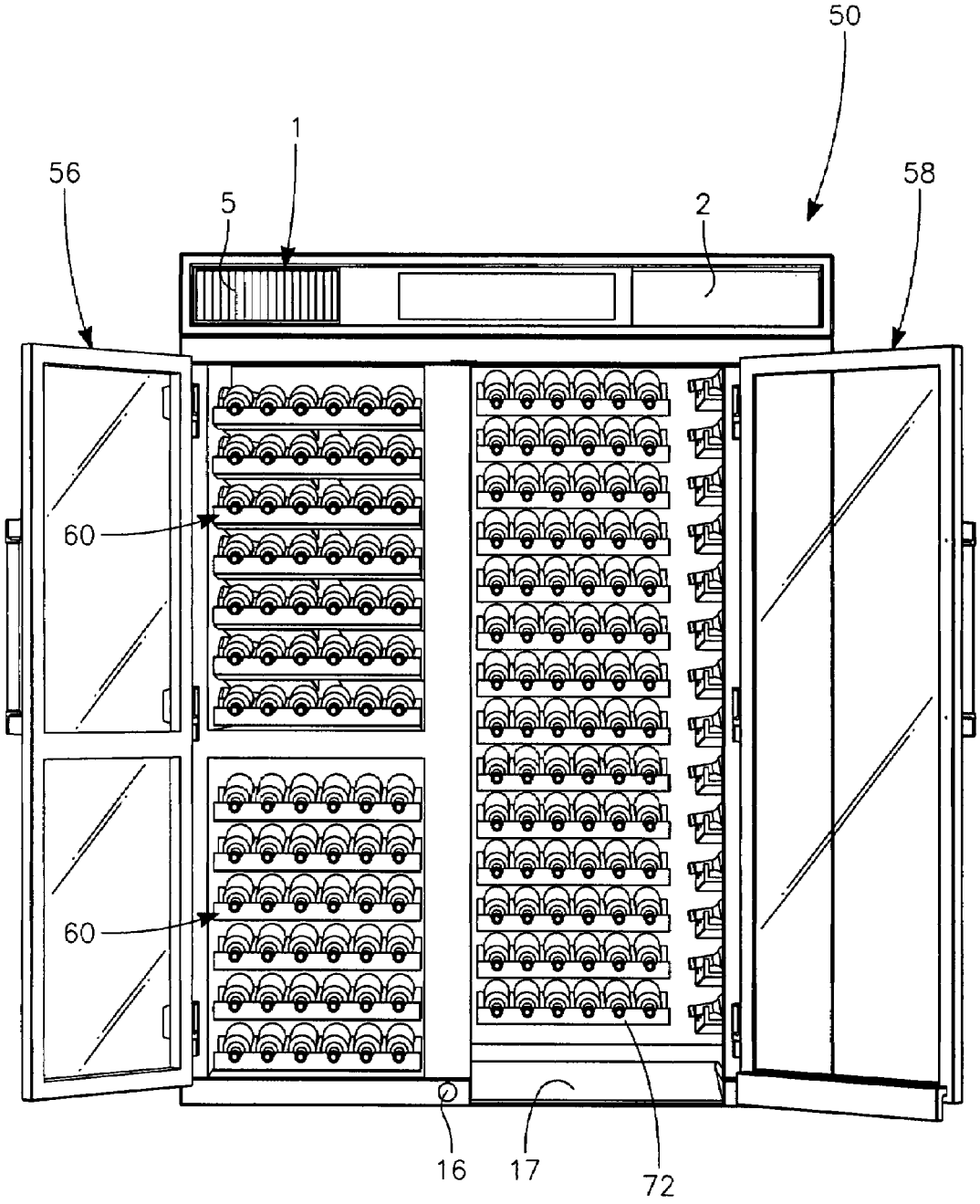
FIG. 8 shows a front elevation view of the walk-in wine cooler/humidor shown in FIGS. 5, 6 and 7, with the door to the walk-in refrigerator section open to show some interior features.

FIGS. 5, 6 and 7 shows walk-in wine cooler/refrigerator unit 50 for home use. Unit 50 includes four stainless-steel walls, 55,51 and 52 and 53, with glass wine access glass door 56 mounted on front panel 51 with side/front mount hinges 14. At the left of front panel 51 is glass wine access door 58, mounted thereto by side/front-mounted hinges 14. Each of doors 56 and 58 has a pull handle 15 to grasp and open these doors. Inside walk-in refrigeration section 54 are master control panel 18, including temperature adjustment switches/dials and status indicators. Wine racks 70 are located in walk-in section 54. Also in panel 51 are temperature monitoring digital indicators 11. Inside chamber 54 are access ramp 17, wine racks 60 on stainless-steel tracks, and humidor section 62. Atop unit 50 are front air intake 1, front air exhaust 2, removable top air intake panel 3, removable top air exhaust panel 4, and air intake filter 5.

As FIG. 7 shows, unit 50, includes an interior space 54 slide out with wood or metal shelves 20, humidor slide-out cabinet system 64, circulation fan system for red wine/humidor area 66, air return channel 68, water purification system 25, humidification system 26, presence sensor 27, evaporator and fan area 28, UV-C air sanitizing system 29, automatic door opening mechanism 30, and urethane foam core insulation 31.

Figure 9:
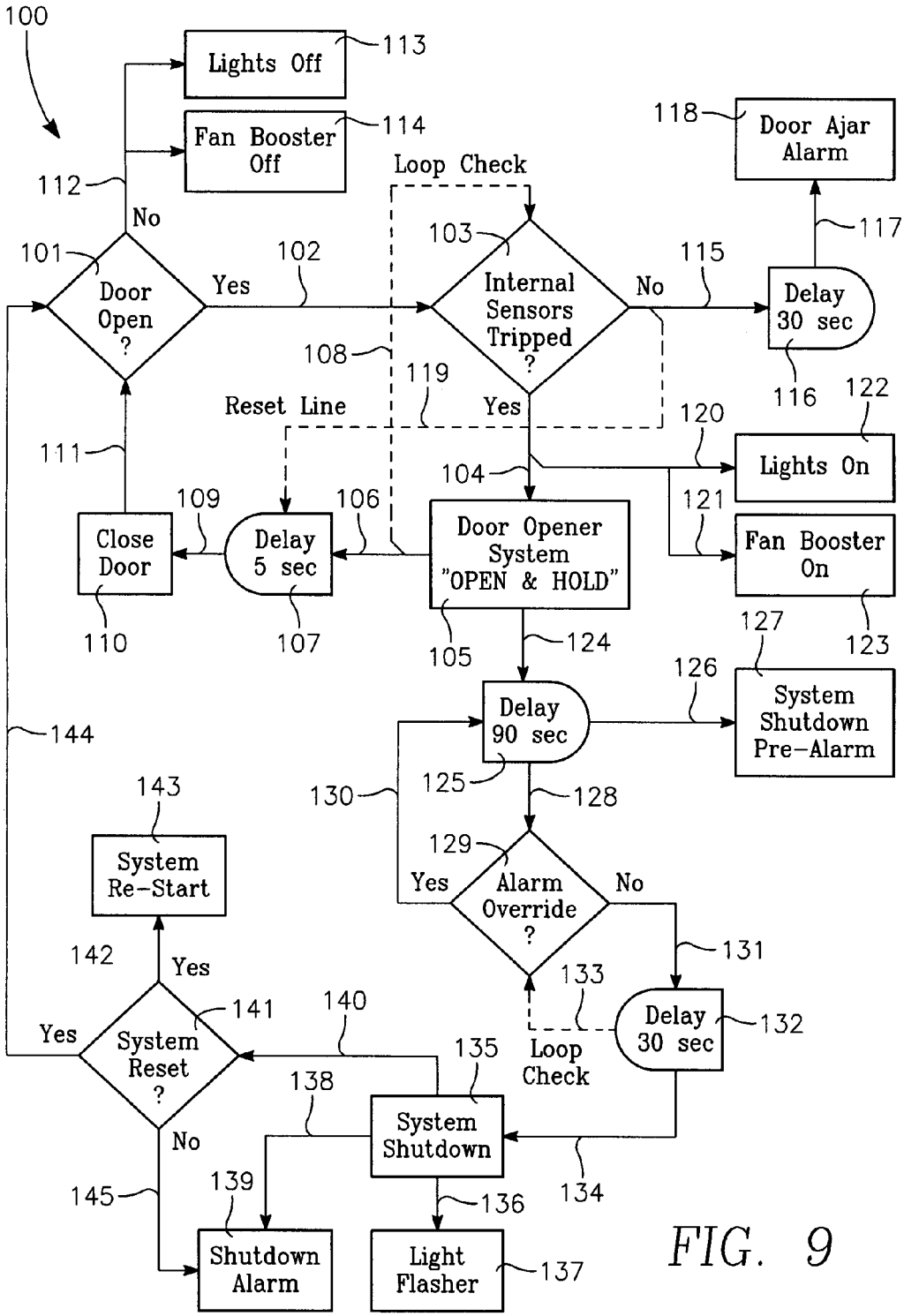
FIG. 9 shows a safety and control flow chart for the walk-in refrigerator/freezer shown in FIGS. 1-4, and for the walk-in wine cooler/humidor shown in FIGS. 5-8.

Referring now to FIG. 9, schematic 100 shows that the control system for the walk-in refrigerator/freezer, shown in FIGS. 1-4, queries, at block 101, whether the door to the walk-in section of the refrigerator is open. If the response is "yes," this signal passes on line 102 to internal sensors system block 103. If the sensors are tripped, a signal passes from block 103 on path 104 to door open system block 105. System 105 passes a signal on path 106 to delay block 107, here, a five-second delay, and, on path 108, passes a signal to sensor block 103 to respond to queries at block 103 as to whether the door is open. After the delay at block 107, a signal passes on path 109 to close-door block 110, which passes a signal on path 111 to block 101 so indicating. If the query of door open block 101 generates a "no" signal on path 112, that signal passes to blocks 113 and 114, which generate turnoff signals for the lights and the fan booster of the unit.

If the internal sensors are not tripped, a "no" signal passes on path 115 to block 116. After an appropriate delay, here 30 seconds, block 116 passes a signal on path 117 to alarm block 118 to generate a door ajar alarm. A "no" signal also passes on path 119 to send a reset signal to the delay block 107. A "yes" signal on path 104 passes on paths 120 and 121 to controls 122 and 123 to turn the lights and fan booster on. If a signal appears from block 105 on path 124, this signal passes to block 125 that generates a delay, here 90 seconds, and then passes a signal on path 126 to systems shutdown pre-alarm block 127. A signal from delay block 125 also appears on path 128 to alarm override block 129.

If alarm override block 129 generates a "yes" signal, this signal passes on path 130 to delay block 125. A "no" signal from alarm override block 129 passes on path 131 to delay block 132. Delay block 132 generates a loop check signal on path 133 and a shutdown signal on path 134. The shutdown signal passes to shutdown block 135, which passes a signal on path 136 to flashing light block 137. System shutdown block 135 also passes a signal on path 138 to shutdown alarm 139, to indicate that the system is OFF and shutdown. System shutdown block 135 also passes a signal on path 140 to system reset block 141. If the system is reset, a "yes" signal passes on path 142, to restart block 143 to restart the system. The "yes" signal also passes on path 144 to door open block 101. A "no" signal from system reset 141, if any, appears on path 145, and passes to shutdown alarm 139, which also indicated that the refrigerator/freezer system is shutdown.

Figure 10A:
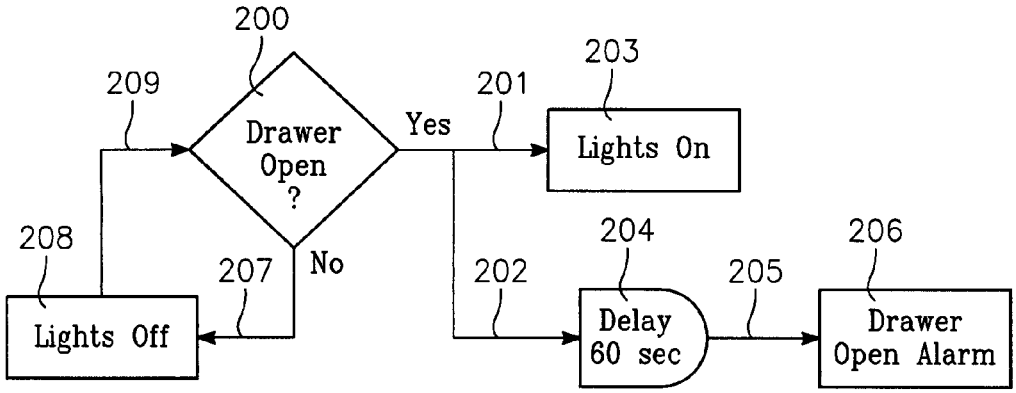
FIG. 10 shows safety and control flow charts for the drawer area and freezer section of the walk-in refrigerator/freezer shown in FIGS. 1-4.

Referring now to FIG. 10A, drawer open block 200 may, when queried, pass a "yes" signal on paths 201 and 202 to turn on the drawer lights at block 203 and to generate a delay at delay block 204. After the delay, a signal passes on path 205 to alarm block 206 to generate a drawer open alarm. If the drawer is not open when block 200 is queried, a "no" signal passes on path 207 to the lights-off block 207, which turns off the lights in the drawer section, and passes a signal on path 208 to the drawer open block, so indicating.

Figure 10B:
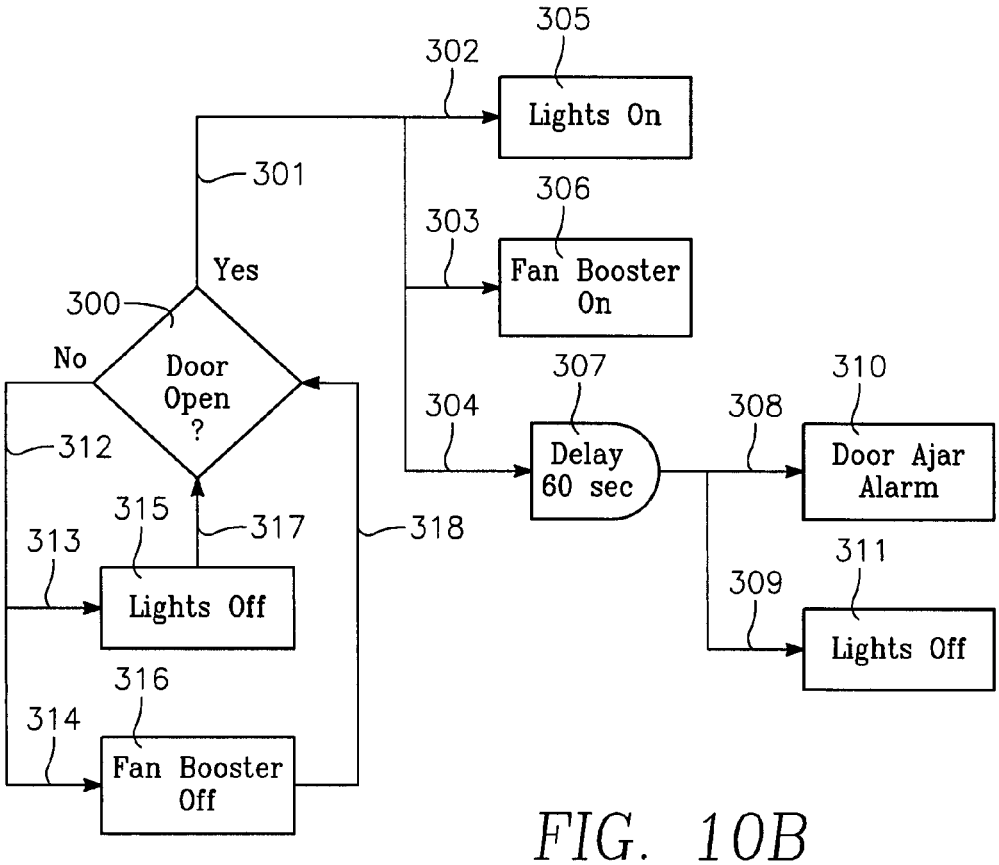

Referring now to FIG. 10B, where door open block 300, may, when queried, pass a "yes" signal on paths 301, 302, 303 and 304 to turn on the lights at block 305, turn on the fan booster at block 306 and to generate a delay at delay block 307. After the delay, a signal passes on paths 308 and 309 to door ajar alarm block 310 and lights off block 311, generating an alarm and turning off the lights, respectively. A "no" signal from door open block 300 passes on paths 312, 313 and 314 to turn off the lights at block 315 and turn off the fan booster at block 316. Signals pass on paths 317 and 318 back to door open block 300, indicating that the lights and the fan booster have been turned off.

Figure 11:
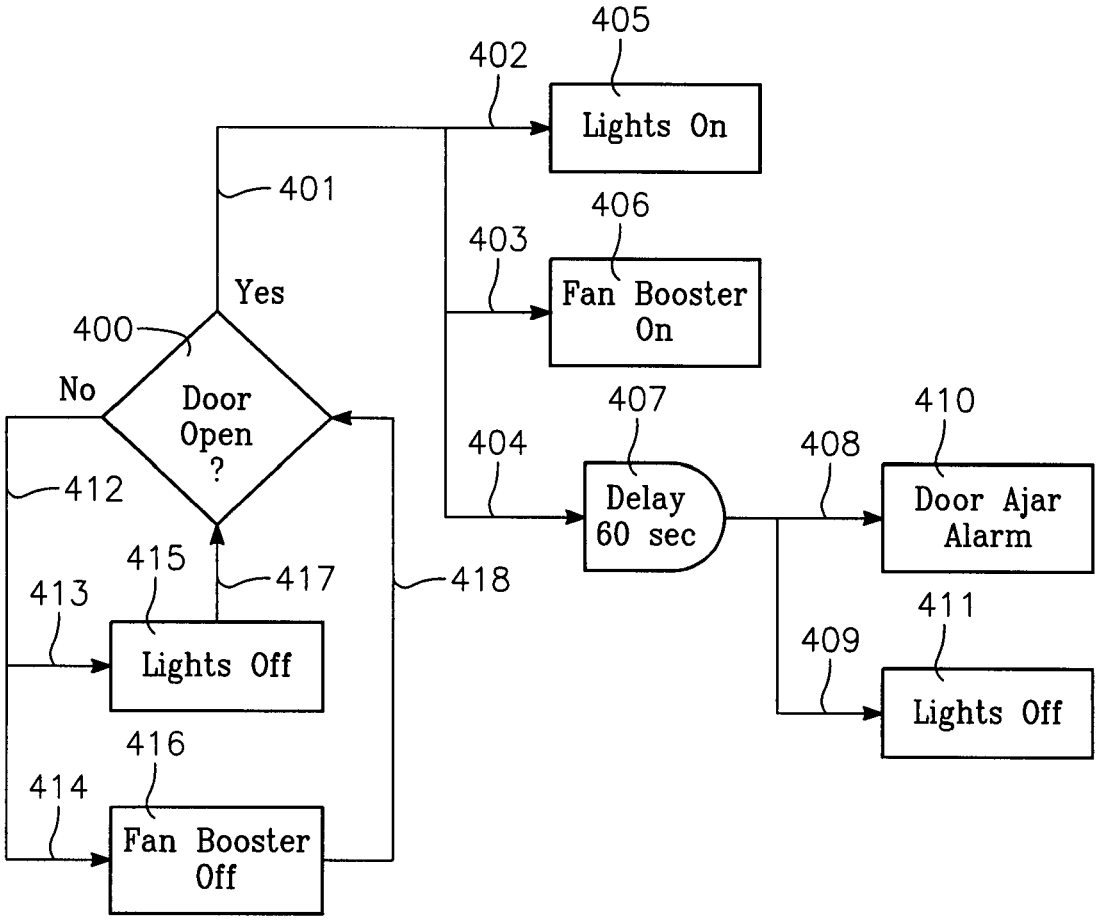
FIG. 11 shows the safety and control flow charts for the outside drawer section of the walk-in wine cooler/humidor shown in FIGS. 5-8.

Referring now to FIG. 11, where door open block 400, when queried, generates a "yes" signal, this signal passes on paths 401, 402, 403 and 404 to lights on block 405, fan booster on block 406 and delay block 407, turning on the lights and fan booster, and generating a delay signal, e.g., 60 seconds. After the delay, a signal passes on paths 408 and 409 to door-ajar alarm block 410 and to the lights off block 411 to raise an alarm and to turn off the lights within the cooler drawer section. A "no" signal on block 400 passes on paths 412, 413 and 414 to lights off block 415 and to fan booster off block 416 to turn off the lights and fan booster. Signals pass on paths 417 and 418 back to door open block 400, to start the query sequencing over again.

The invention claimed is:

1. A walk-in refrigerator/freezer unit for use in homes and other non-commercial venues, includes a walk-in refrigerator section, a reach-in freezer section, a plurality of pull-out refrigerated drawers and doors for entry into the walk-in refrigerator section, a door for entry into the reach-in freezer sections, from the interior of said walk-in refrigerator section, an internal motion sensor, or a pressure sensitive ramp, or both, that actuates a safety lock for at least one door to said walk-in refrigerator section, and an external size/shape that can fit into kitchens and pantries in homes and other non-commercial venues.

2. A walk-in refrigerator/wine cooler unit for use in homes and other non-commercial venues, includes a walk-in refrigerator section, a reach-in wine cooler section, one or more pull-out refrigerated drawers, an entry door for entrance into the walk-in refrigerator section, and one or more doors for entry into the reach-in wine cooler section, an internal motion sensor, or a pressure sensitive ramp, or both, that actuates a safety lock for at least one door to said walk-in refrigerator section, from the interior of said walk-in refrigerator section, and an external size/shape that can fit into in home locations and into other non-commercial venues.

3. The walk-in refrigerator/freezer unit of claim 1 further comprising a refrigerator storage capacity of at least about 60 cubic feet, and a freezer storage capacity of at least about 20 cubic feet.

4. The walk-in refrigerator/freezer unit of claim 1 or claim 3 further comprising one or more interior rails for storage of bottles, glasses or both inside the freezer section.

5. The walk-in refrigerator/wine cooler unit of claim 2 further comprising a plurality of interior wine bottle storage racks and a plurality of slideable wine bottle storage shelves.

6. The walk-in refrigerator/freezer unit of claim 1 or claim 3 further comprising an ice maker in said reach-in freezer section.

7. The walk-in refrigerator/freezer unit of claim 1, claim 2, or claim 3 further comprising a refrigeration system that creates a cold discharge air barrier at the opening of doors between the inside and the outside of said unit.

8. The walk-in refrigerator/freezer unit of claim 1, claim 2, or claim 3 further comprising a forced-air refrigeration, evaporation, and condensing system.

9. The walk-in refrigerator/freezer unit of claim 8 wherein said forced-air refrigeration system is inside said unit.

* * * * *